US007850093B2

(12) United States Patent
Burton et al.

(10) Patent No.: US 7,850,093 B2
(45) Date of Patent: Dec. 14, 2010

(54) SYSTEM, METHOD AND APPARATUS FOR AGITATED AND PRESSURIZED RESERVOIR MOUNTED DIRECTLY TO AUTOMATED SPRAY DISPENSER

(75) Inventors: Larry T. Burton, Crowley, TX (US); James R. Reed, Azle, TX (US); Jacob A. Johnson, Canyon Country, CA (US); Kelly B. Choban, Aledo, TX (US)

(73) Assignee: Lockheed Martin Corporation, Bethesda, MD (US)

( * ) Notice: Subject to any disclaimer, the term of this patent is extended or adjusted under 35 U.S.C. 154(b) by 371 days.

(21) Appl. No.: 12/023,245

(22) Filed: Jan. 31, 2008

(65) Prior Publication Data

US 2009/0194609 A1 Aug. 6, 2009

(51) Int. Cl.
*B05B 9/00* (2006.01)

(52) U.S. Cl. ..... 239/142; 239/302; 239/337; 366/247; 366/249; 366/605

(58) Field of Classification Search ..... 239/142, 239/302, 337; 366/247, 249, 605
See application file for complete search history.

(56) References Cited

U.S. PATENT DOCUMENTS 2,959,358 A * 11/1960 Vork ..... 239/330
3,042,310 A * 7/1962 Franke et al. ..... 239/142
3,182,915 A * 5/1965 Arwine ..... 239/142
3,637,135 A 1/1972 Luderer et al.
4,095,286 A 6/1978 Ellis
4,282,131 A 8/1981 Trousil
4,401,268 A * 8/1983 Pomponi, Jr. ..... 239/142
4,501,500 A * 2/1985 Terrels ..... 366/250
4,539,049 A 9/1985 Cohen
4,952,650 A 8/1990 Young et al.
6,494,387 B1 12/2002 Kaneko
6,854,669 B2 2/2005 Anthony
6,886,974 B1 5/2005 Millian et al.
6,942,161 B2 9/2005 Shimada
2003/0132311 A1 7/2003 Dorendorf et al.
2004/0222318 A1 11/2004 Dorendorf et al.
2005/0284963 A1 12/2005 Reedy

* cited by examiner

*Primary Examiner*—Dinh Q Nguyen
(74) *Attorney, Agent, or Firm*—Bracewell & Giuliani LLP

(57) ABSTRACT

An agitated and pressurized paint pot that is mounted directly to a paint spray dispenser uses a small volume pressurized pot with constant agitation. This design prevents the settling of material and ensures that the materials are applied through the system at a consistent feed rate to meet the specific needs of applying radar absorbing materials.

30 Claims, 1 Drawing Sheet

SYSTEM, METHOD AND APPARATUS FOR AGITATED AND PRESSURIZED RESERVOIR MOUNTED DIRECTLY TO AUTOMATED SPRAY DISPENSER

BACKGROUND OF THE INVENTION

1. Technical Field

The present invention relates in general to spray dispensers for applying liquids and, in particular, to an improved system, method, and apparatus for an agitated and pressurized reservoir that is mounted directly to a paint spray dispenser.

2. Description of the Related Art

In laboratory research and development, very small quantities of experimental radar absorbing materials (RAM) are carefully applied to test articles in a paint-like form using automated spray dispensing systems. Because of the extremely limited availability and extraordinary cost of some experimental RAMs (i.e., some on the order of $40,000 per gallon), only very small volumes on the order of one pint or less are available for research and development.

During the spray application process, RAM require constant agitation to prevent the critical filler components from settling in the suspending liquid in order to provide a highly homogenous application with very consistent physical properties. Non-agitation results in irregular material feed rates and inconsistent applications that compromise system performance. Accurate and repeatable spray application of small quantities of RAM currently presents a significant problem.

Although there are several types of spray systems that meet some of the requirements for applying RAM, there is no existing commercial spray system that meets all of the requirements for applying experimental quantities of RAM. Existing spray systems that are compatible with limited volume materials use one of two general classes of automated paint delivery and application systems. The first type is a suction or gravity-fed system with a small volume (e.g., one quart) paint reservoir or "pot" mounted on the dispenser or "gun." With suction devices the pot is typically located below the gun, while with gravity-fed devices the pot is located above the gun. The second type of system comprises a pressurized, large volume pot (e.g., 5 gallons) that is separated and located upstream from the gun. A hose having a length of about 10 to 50 feet is used to deliver the paint from the pot to the gun.

These existing spray systems have several limitations that make their use difficult for experimental RAM application. For example, current suction or gravity-fed RAM application systems do not contain an agitation mechanism, such as the propellers rotated at the bottoms of large volume pots to provide constant stirring during the painting operation. To overcome this limitation, painters are required to regularly stir the paint by hand. This stirring is accomplished by physically shaking the pot and gun system and is difficult to standardize. Painters usually stir the material with an amplitude and frequency that varies significantly with the training, experience and preference of the painter. Lack of a regulated stirring method results in significant variation in the performance of the final system.

Moreover, existing suction or gravity-fed systems contain no pressure regulation gauge. These systems use pressurized air flowing across an orifice in the pot to draw the paint out of the pot such that it is propelled by the pressurized air and then released through the nozzle. Since there is no pressure regulation gauge on this system it is impossible to standardize a delivery pressure. Delivery pressure is a critical application parameter in the application of RAM, and variations in application result in performance fluctuations of the final system. With current systems, painters adjust the feed line pressure that again varies based on their experience level. This lack of standardization of pressure settings again results in significant variation in the performance of the final system.

The large volume detached pots overcome the primary disadvantages of the suction or gravity fed systems by using pressurized air to force paint out of the pot into the gun and nozzle (which is regulated by a pressure gauge). Large volume systems also have internal agitation mechanisms. However, their use in application of experimental RAM is limited because of the large volumes required to operate them. The smallest existing systems require one to two quarts of paint to hold a minimum pressure charge and because of inefficient shaping of the pot and the use of lengthy hoses between the pots and the spray guns. As a result the actual volume of paint that can be sprayed is significantly less than the original volume. Although these systems can be utilized to standardize spray applications, their large volume requirements make them unfeasible for many developmental activities. Thus, an improved RAM application system would be desirable.

SUMMARY OF THE INVENTION

Embodiments of a system, method and apparatus for an agitated and pressurized paint pot that is mounted directly to a paint spray dispenser are disclosed. The invention uses a small volume, pressurized pot with constant agitation. This design prevents the settling of material and ensures that the materials are applied through the system at a consistent feed rate to meet the specific needs of highly specialized RAM research and development activities.

For example, a small pressure pot that is capable of delivering and dispensing less than one pint of material is provided. Agitation is used within the pot to prevent material settling, positive pressure drives the paint through the system, and a pressure regulator is provided for the accurate regulation of spray pressure. Moreover, since the pot is located immediately adjacent the dispensing nozzle on the spray gun, no hoses requiring excessive paint material volumes are used.

In one embodiment, physical rather than magnetic agitation is provided by a small propeller. The agitator may be located below the intake port to provide a more consistent material. In addition, the agitator may be oriented at angle to normal to further enhance the consistency of the material being dispensed. In other advantages of the invention, a larger range of viscosities may be accommodated without requiring a gravity-based system, which would inherently first provide the heaviest particles in the paint.

The foregoing and other objects and advantages of the present invention will be apparent to those skilled in the art, in view of the following detailed description of the present invention, taken in conjunction with the appended claims and the accompanying drawings.

BRIEF DESCRIPTION OF THE DRAWINGS

So that the manner in which the features and advantages of the present invention are attained and can be understood in more detail, a more particular description of the invention briefly summarized above may be had by reference to the embodiments thereof that are illustrated in the appended drawings. However, the drawings illustrate only some embodiments of the invention and therefore are not to be considered limiting of its scope as the invention may admit to other equally effective embodiments.

DETAILED DESCRIPTION OF THE INVENTION

Figure 1:
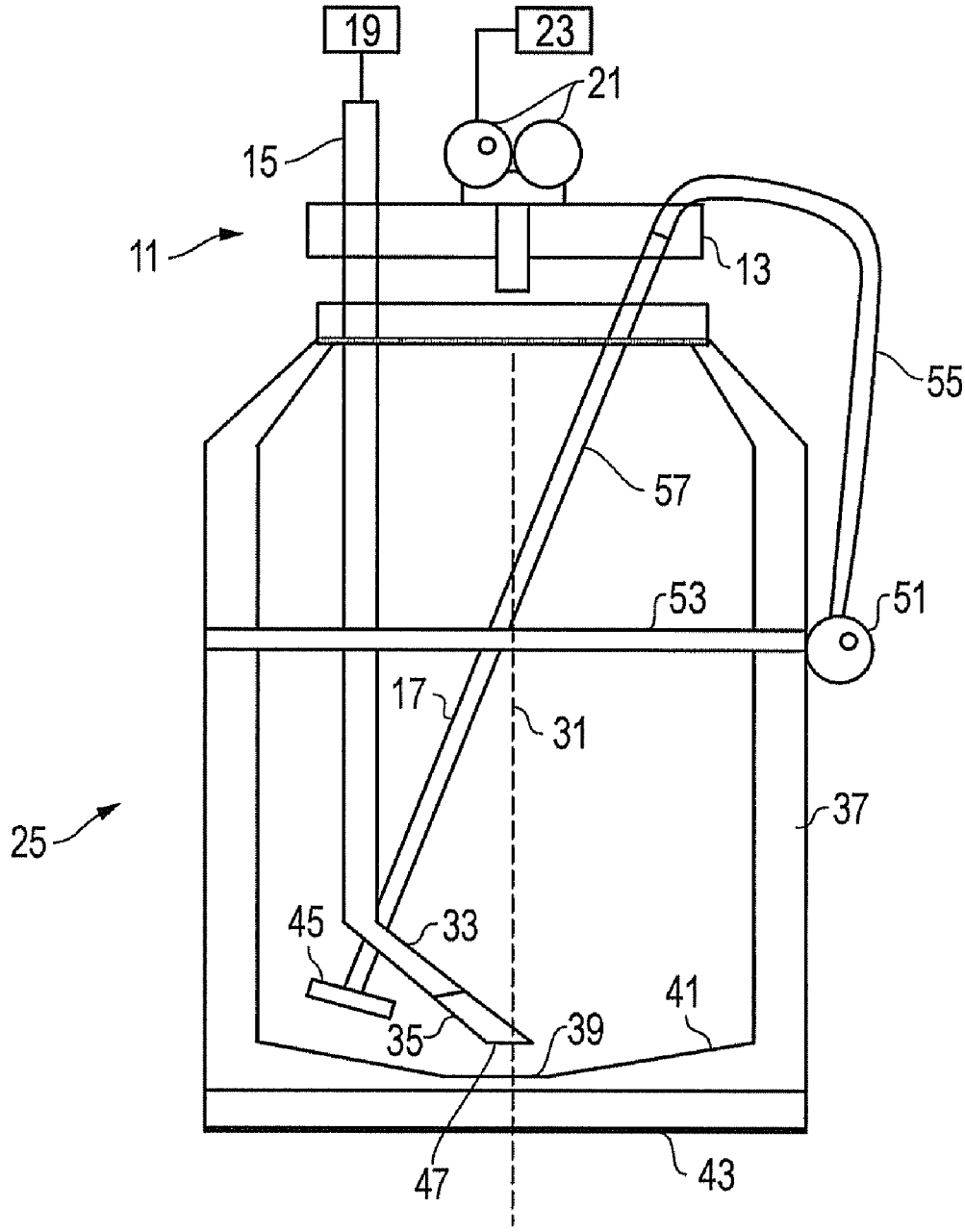
FIG. 1 is a schematic, partially-exploded, sectional side view of one embodiment of a painting system constructed in accordance with the invention.

Referring to FIG. 1, embodiments of a system, method and apparatus for dispensing a fluid are disclosed. The invention is well suited for dispensing and spraying paint or other types of fluids capable of being dispensed in such a manner, such as a spray gun and pressure pot application.

In one embodiment, the invention comprises a dispenser 11 having cap 13, a downward extending intake tube 15, a downward extending agitator 17, a nozzle 19 (e.g., spray gun), and a pressure regulator and air gauge 21 for regulating a pressure of a spray released by the nozzle. A pressure source 23 (e.g., compressed air) is connected to the pressure regulator and air gauge 21 for pressurizing a fluid in a fluid reservoir 25.

The reservoir 25 is mounted (e.g., threaded) to the cap 13 to form and provide an adequate pressure seal. The reservoir 25 is mounted to the dispenser 11 such that the intake tube 15 and the agitator 17 extend through the cap 13 and into the reservoir 25. The reservoir 25 has a maximum fluid capacity of about one quart or less to provide a minimum distance for the fluid to travel from the bottom of the reservoir 25 to the nozzle 19.

In one embodiment, the reservoir has an axis 31 (e.g., axis of rotation) about which the reservoir is rotationally symmetric. The intake tube 15 is oriented in a parallel direction with respect to the axis 31. The intake tube 15 has a distal end 33 that may be angled as shown, and to which is mounted a flexible tube 35 that is oriented at an acute angle with respect to the axis 31. The reservoir 25 has a sidewall 37 that is parallel to the axis 31, a bottom 39 that is perpendicular to the axis 31, and a sloped portion 41 that is tapered from the sidewall 37 to the bottom 39. A metal band 43 may be added to the outer circumference of the bottom portion of the reservoir 25 to provide a stable platform for the system.

As shown in FIG. 1, the agitator 17 may be located on a support that is not parallel to the axis 31. This design improves a consistency of the material being dispensed. The agitator provides constant agitation of the fluid in reservoir 25 to prevent settling of material in the fluid. The agitator 17 may comprise a propeller or an impeller 45 for providing physical agitation of the fluid. The propeller 45 may be rotated up to 800 rpm to avoid over-agitating the fluid and causing cavitation thereof. In one embodiment, a pressure range of up to 15 psi may be maintained in the reservoir 25 during operation. In addition, the propeller 45 may be located over the sloped portion 41 of the reservoir 25 as shown.

Although the propeller 45 of the agitator 17 is shown as located vertically above a distal end 47 of the intake tube 15, propeller 45 may be located below the distal end 47 of the intake tube 15. In addition, the distal end 47 of the intake tube may align with axis 31 is shown so that the fluid is drawn into the intake tube 15 from the center and bottom 39 of the reservoir 25. Moreover, the distal end 47 may be located within 0.125 inches from bottom 39 as measured along the axis 31.

In the embodiment shown, the agitator 17 further comprises an agitator motor 51 mounted to the sidewall 37 of the reservoir 25 with a metal strap 53. A drive cable 55 extends from the agitator motor 51 to an impeller shaft 57, and the impeller 45 is mounted to a distal end of the impeller shaft 57.

While the invention has been shown or described in only some of its forms, it should be apparent to those skilled in the art that it is not so limited, but is susceptible to various changes without departing from the scope of the invention.

What is claimed is:

1. A dispensing system, comprising:

a dispenser having an intake tube, an agitator, a nozzle and a pressure regulator for regulating a pressure of a spray released by the nozzle;

a reservoir mounted to the dispenser such that the intake tube and the agitator extend into the reservoir, wherein the reservoir has an axis, the intake tube is oriented in a parallel direction with respect to the axis and has a distal end to which is mounted a flexible tube that is oriented at an acute angle with respect to the axis, and the agitator is located on a support that is not parallel to the axis; and a pressure source for pressurizing a fluid in the reservoir.

2. A dispensing system according to claim 1, wherein the reservoir has a maximum fluid capacity of one quart, and the agitator provides constant agitation to prevent settling of material in a fluid located in the reservoir.

3. A dispensing system according to claim 1, wherein the dispenser further comprises a cap, the reservoir is mounted directly to the cap, and the intake tube extends through the cap between the nozzle and the reservoir.

4. A dispensing system according to claim 1, wherein the agitator comprises a propeller for providing physical agitation of the fluid.

5. A dispensing system according to claim 4, wherein the propeller is rotated at up to 800 rpm to avoid over-agitating the fluid and causing cavitation thereof, and a pressure range of up to 15 psi is maintained in the reservoir.

6. A dispensing system according to claim 1, wherein the agitator is located below a distal end of the intake tube, and the dispenser is a paint spray gun.

7. A dispensing system according to claim 1, wherein the agitator further comprises an agitator motor mounted to a sidewall of the reservoir with a metal strap, and a drive cable extending from the agitator motor to an impeller shaft, and an impeller mounted to a distal end of the impeller shaft.

8. A dispensing system. comprising:

a dispenser having an intake tube, an agitator, a nozzle and a pressure regulator for regulating a pressure of a spray released by the nozzle;

a reservoir mounted to the dispenser such that the intake tube and the agitator extend into the reservoir, wherein the reservoir has an axis and a sidewall that is parallel to the axis, a bottom that is perpendicular to the axis, and a sloped portion that is tapered from the sidewall to the bottom, the intake tube is oriented in a parallel direction with respect to the axis, and the agitator is located on a support that is not parallel to the axis; and a pressure source for pressurizing a fluid in the reservoir.

9. A dispensing system according to claim 8, wherein the reservoir has a maximum fluid capacity of one quart, and the agitator provides constant agitation to prevent settling of material in a fluid located in the reservoir.

10. A dispensing system according to claim 8, wherein the dispenser further comprises a cap, the reservoir is mounted directly to the cap, and the intake tube extends through the cap between the nozzle and the reservoir.

11. A dispensing system according to claim 8, wherein the agitator comprises a propeller for providing physical agitation of the fluid.

12. A dispensing system according to claim 11, wherein the propeller is rotated at up to 800 rpm to avoid over-agitating the fluid and causing cavitation thereof, and a pressure range of up to 15 psi is maintained in the reservoir.

13. A dispensing system according to claim 8, wherein the agitator is located below a distal end of the intake tube, and the dispenser is a paint spray gun.

14. A dispensing system according to claim 8, wherein the agitator further comprises an agitator motor mounted to a sidewall of the reservoir with a metal strap, and a drive cable extending from the agitator motor to an impeller shaft, and an impeller mounted to a distal end of the impeller shaft.

15. A system for dispensing and spraying paint, comprising:

a dispenser having an intake tube, an agitator, a nozzle and a pressure regulator for regulating a pressure of a spray released by the nozzle; and a reservoir mounted to the dispenser such that the intake tube and the agitator extend into the reservoir, and the reservoir has a maximum fluid capacity of about one quart, wherein the reservoir has an axis, the intake tube is oriented in a parallel direction with respect to the axis, and has a distal end to which is mounted a flexible tube that is oriented at an acute angle with respect to the axis and the agitator is located on a support that is not parallel to the axis.

16. A system according to claim 15, wherein the agitator provides constant agitation to prevent settling of material in a fluid located in the reservoir.

17. A system according to claim 15, further comprising a pressure source for pressurizing a fluid in the reservoir.

18. A system according to claim 15, wherein the dispenser is a spray gun and the reservoir is located immediately adjacent the nozzle.

19. A system according to claim 15, wherein the agitator comprises a propeller for providing physical agitation of the fluid.

20. A system according to claim 19, wherein the propeller is rotated at up to 800 rpm to avoid over-agitating the fluid and causing cavitation thereof, and a pressure range of up to 15 psi is maintained in the reservoir.

21. A system according to claim 15, wherein the agitator is located below a distal end of the intake tube.

22. A system according to claim 15, wherein the reservoir has a sidewall that is parallel to the axis, a bottom that is perpendicular to the axis, and a sloped portion that is tapered from the sidewall to the bottom.

23. A system for dispensing and spraying paint, comprising:

a dispenser having an intake tube, an agitator, a nozzle and a pressure regulator for regulating a pressure of a spray released by the nozzle; and a reservoir mounted to the dispenser such that the intake tube and the agitator extend into the reservoir, and the reservoir has a maximum fluid capacity of about one quart; wherein the agitator further comprises an agitator motor mounted to a sidewall of the reservoir with a metal strap, and a drive cable extending from the agitator motor to an impeller shaft, and an impeller mounted to a distal end of the impeller shaft.

24. A system according to claim 23, wherein the reservoir has an axis, the intake tube is oriented in a parallel direction with respect to the axis, and the agitator is located on a support that is not parallel to the axis.

25. A system according to claim 23, wherein the agitator provides constant agitation to prevent settling of material in a fluid located in the reservoir.

26. A system according to claim 23, further comprising a pressure source for pressurizing a fluid in the reservoir.

27. A system according to claim 23, wherein the dispenser is a spray gun and the reservoir is located immediately adjacent the nozzle.

28. A system according to claim 23, wherein the impeller is rotated at up to 800 rpm to avoid over-agitating the fluid and causing cavitation thereof, and a pressure range of up to 15 psi is maintained in the reservoir.

29. A system according to claim 23, wherein the agitator is located below a distal end of the intake tube.

30. A system according to claim 23, wherein the reservoir has a sidewall that is parallel to the axis, a bottom that is perpendicular to the axis, and a sloped portion that is tapered from the sidewall to the bottom.

* * * * *